US010431193B2

(12) United States Patent
Setoguchi

(10) Patent No.: US 10,431,193 B2
(45) Date of Patent: Oct. 1, 2019

(54) ELECTRONIC MUSICAL INSTRUMENT, METHOD OF CONTROLLING THE ELECTRONIC MUSICAL INSTRUMENT, AND STORAGE MEDIUM THEREOF

(71) Applicant: CASIO COMPUTER CO., LTD., Shibuya-ku, Tokyo (JP)

(72) Inventor: Masaru Setoguchi, Kunitachi (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/130,392

(22) Filed: Sep. 13, 2018

(65) Prior Publication Data

US 2019/0096372 A1 Mar. 28, 2019

(30) Foreign Application Priority Data

Sep. 26, 2017 (JP) ..... 2017-184585

(51) Int. Cl.
*G10H 1/06* (2006.01)
*G10H 1/00* (2006.01)

(52) U.S. Cl.
CPC ..... *G10H 1/06* (2013.01); *G10H 1/0033* (2013.01)

(58) Field of Classification Search
CPC ..... G10H 1/06; G10H 1/0033
USPC ..... 84/622
See application file for complete search history.

(56) References Cited

U.S. PATENT DOCUMENTS 4,651,612 A * 3/1987 Matsumoto ..... G09B 15/08 84/470 R
5,274,192 A * 12/1993 Kumagai ..... G10H 1/0041 84/462
5,471,008 A * 11/1995 Fujita ..... G10H 1/0066 84/477 R
5,565,641 A * 10/1996 Gruenbaum ..... G10H 1/0066 84/451
5,656,789 A 8/1997 Nakada et al.
5,847,306 A * 12/1998 Wakuda ..... G10H 1/0008 84/649
6,150,597 A * 11/2000 Kakishita ..... G10H 1/0025 84/477 R (Continued)

FOREIGN PATENT DOCUMENTS

JP H07287570 A 10/1995
JP 2007286087 A 11/2007
JP 2009086084 A 4/2009

*Primary Examiner* — David S Warren
(74) *Attorney, Agent, or Firm* — Holtz, Holtz & Volek PC

(57) ABSTRACT

According to the present invention, there is provided an electronic musical instrument that allows a player to learn a certain range covering a key of correct pitch and to feel as if he or she were playing the music.

The instrument includes a controller to perform a pitches determination process of, based upon first timing and first pitch included in music data, determining pitches within a fixed range from the first pitch, which is allowed to be designated in accordance with the first timing, a display process of displaying an identifier to identify the pitches determined, and an automatic playing process of advancing automatic playing of the music data by producing sound corresponding to the first pitch from a sound producing unit when one of the pitches identified by the identifier displayed by the display process is designated.

11 Claims, 11 Drawing Sheets

(56) References Cited

U.S. PATENT DOCUMENTS 6,410,839 B2 * 6/2002 Okubo ..... G10H 1/0016 84/637
7,030,307 B2 * 4/2006 Wedel ..... G09B 15/02 84/477 R
7,608,774 B2 * 10/2009 Ohmura ..... G10H 1/0016 84/169
7,626,109 B2 * 12/2009 Katou ..... G09B 15/08 84/477 R
7,825,320 B2 * 11/2010 Yatsui ..... G10H 1/0025 84/609
8,513,511 B2 * 8/2013 Ikeya ..... G09B 15/08 84/478
8,723,011 B2 * 5/2014 Matsumoto ..... G10H 1/40 84/609
8,933,309 B2 * 1/2015 Oba ..... G10F 1/02 84/17
9,330,648 B2 * 5/2016 Matsunaga ..... G10H 7/04
9,836,992 B2 * 12/2017 McCarthy ..... G09B 15/003
10,096,306 B2 * 10/2018 Akazawa ..... G10H 1/38
2004/0123726 A1 * 7/2004 Kato ..... G10H 1/0008 84/609
2006/0207411 A1 * 9/2006 Ohmura ..... G10H 1/0016 84/600
2007/0089590 A1 * 4/2007 Katou ..... G09B 15/08 84/609
2007/0234882 A1 * 10/2007 Usa ..... G10H 1/0008 84/612
2008/0072744 A1 * 3/2008 Ito ..... G10H 1/28 84/638
2008/0245213 A1 * 10/2008 Izumisawa ..... G10H 1/0575 84/604
2012/0255424 A1 * 10/2012 Matsumoto ..... G10H 1/40 84/611
2014/0260898 A1 * 9/2014 Bales ..... G09B 15/026 84/433
2016/0284228 A1 * 9/2016 McCarthy ..... G09B 15/003
2018/0068643 A1 * 3/2018 Ishioka ..... G10H 1/0033
2018/0277077 A1 * 9/2018 Nakamura ..... G10H 1/0016

* cited by examiner

ELECTRONIC MUSICAL INSTRUMENT, METHOD OF CONTROLLING THE ELECTRONIC MUSICAL INSTRUMENT, AND STORAGE MEDIUM THEREOF

CROSS-REFERENCE TO RELATED APPLICATION

This application is based upon and claims the benefit of priority from Japanese Patent Application No. 2017-184585, filed Sep. 26, 2017, the entire contents of which are incorporated herein by reference.

FIELD

Embodiments described herein relate generally to an electronic musical instrument, a method of controlling the electronic musical instrument, and a storage medium thereof.

BACKGROUND

Conventionally, electronic keyboards with lighted keys have been known. Some of the electronic keyboards have various lesson functions of practicing playing music. One lesson function is to stop music until a player as a learner presses a correct key.

Another lesson function is to blink a key until when a player should press the key and advance an accompaniment until when the player should press the key. If the player does not press the key though the key should be pressed, the key, which is blinking to urge the player to press the key, lights. If the player presses any key, the musical tone corresponding to the pressed key advances to the next one.

Patent Literature: Jpn. Pat. Appln. KOKAI Publication No. 2007-286087

In the case of a lesson in stopping music until a player presses a correct key, the playing of the music is interrupted. Thus, it is particularly difficult for a beginner to feel as if he or she were playing the music. In the case of a lesson in advancing to the next musical tone of music when a player presses any key, the music advances even though the key is not pressed with correct pitch. Thus, even a beginner can feel as if he or she were playing the music.

In the above latter case, however, music advances if a player has only to press a key irrespective of the pitch of the key. In other words, music advances even though a player does not press a key with correct pitch. From the viewpoint that the player learns playing the music, therefore, the lesson particularly brings about no advantage, except that the player learns the timing of key pressing.

The present invention has been developed in consideration of the above situation and its advantage is to provide an electronic musical instrument that allows a player to learn a certain range covering a key of correct pitch.

SUMMARY

According to a first aspect of the invention, there is provided an electronic musical instrument comprising: a first key that is assigned a sound of a first pitch, wherein the first key is determined based on pitch information indicating the first pitch of a first timing included in music data, the first key is expected to be designated by a user within a first period according to the first timing; a second key that is assigned a sound of a second pitch, wherein the second key is determined based on pitch information indicating the second pitch of a second timing after the first timing included in the music data, the second key is expected to be designated by the user within a second period according to the second timing; at least one third key that is assigned a sound of different pitch from the first pitch, wherein the at least one third key is determined based on a relationship with the first key; and a processor that executes the following: a display process of displaying an identifier for identifying the at least one third key before the first timing in accordance with the music data progress; an automatic playing process of progressing the music data from the first timing to a timing before the second timing in response to an operation that the user designates the first key or the at least one third key within the first period, wherein in the automatic playing process, even if a key other than the first key and the at least one third key is designated, the automatic playing from the first timing to a timing before the second timing in the music data does not progress, in response to designation of the at least one third key, even if the first key is not designated, the sound of the first pitch corresponding to the first key is playing back and the automatic playing from the first timing to a timing before the second timing in the music data progresses.

BRIEF DESCRIPTION OF THE DRAWINGS

The present invention will be more understood with reference to the following detailed descriptions with the accompanying drawings.

DETAILED DESCRIPTION

An electronic musical instrument according to an embodiment of the present invention will be described below with reference to the drawings.

The electronic musical instrument according to the embodiment is an electronic keyboard musical instrument with lighted keys. When a player takes lessons in playing music, keys in a predetermined range covering keys to be pressed next are lighted. The player can thus learn a certain range covering a key of Correct pitch as well as the timing of key pressing and feel as if he or she were playing the music.

1. Electronic Keyboard Musical Instrument 100

The electronic keyboard musical instrument 100 according to the embodiment will be described below with reference to FIGS. 1 and 2. The electronic keyboard musical instrument 100 shown in FIGS. 1 and 2 is used in the operation of an electronic keyboard musical instrument 100 according to each of first to third embodiments described later.

Figure 1:
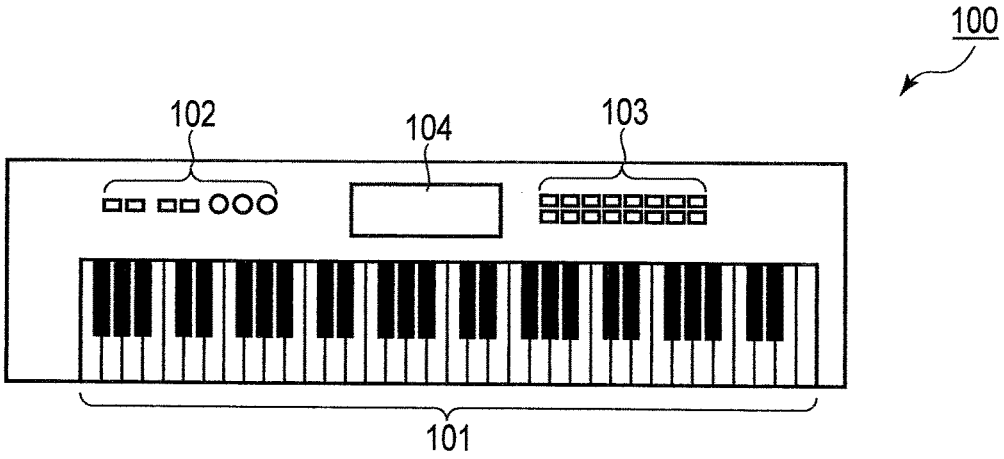
FIG. 1 is an external view showing an electronic keyboard musical instrument 100 according to an embodiment.

FIG. 1 is an external view of the electronic keyboard musical instrument 100 according to the embodiment.

As shown in FIG. 1, the electronic keyboard musical instrument 100 includes a keyboard 101 having a plurality of keys as playing operators to designate pitch and having a function of lighting each of the keys, a first switch panel 102 to make settings of volume, automatic playing, tempo of the automatic playing, etc., a second switch panel 103 to select a mode of a lesson according to the embodiment and also select automatic playing music and a tone of the music, a liquid crystal display (LCD) 104 to display the lyrics of the automatic playing music and information of the settings, and the like. The electronic keyboard musical instrument 100 also includes a speaker to produce sound generated by the playing on its reverse portion, side portion, rear portion or the like, though it is not shown.

Figure 2:
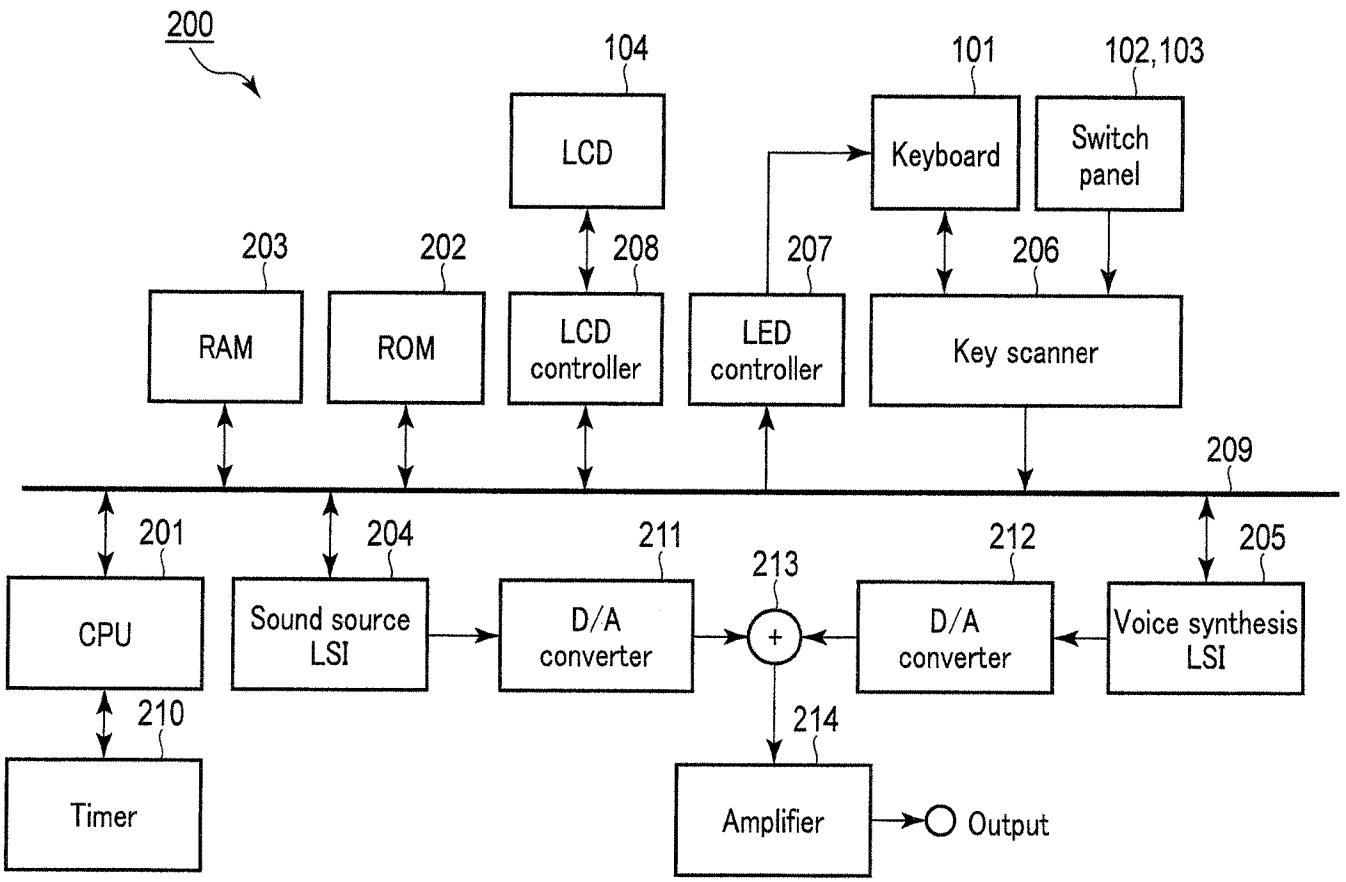
FIG. 2 is a block diagram showing hardware of a control system 200 of the electronic keyboard musical instrument 100 according to the embodiment.

FIG. 2 is a block diagram showing hardware of a control system 200 of the electronic keyboard musical instrument 100 according to the embodiment. As shown in FIG. 2, the control system 200 includes a CPU 201, a ROM 202, a RAM 203, a sound source LSI 204, a voice synthesis LSI 205, a key scanner 206, a light emitting diode (LED) controller 207 and an LCD controller 208, which are connected to a system bus 209. The keyboard 101, first switch panel 102 and second switch panel 103 shown in FIG. 1 are connected to the key scanner 206. The LED controller 207 controls emission of LEDs that function as identifiers (including first and second identifiers) by lighting each key of the keyboard 101. The LCD 104 shown in FIG. 1 is connected to the LCD controller 208.

The CPU 201 executes control programs stored in the ROM 202 using the RAM 203 as a work memory to perform the control operation of the electronic keyboard musical instrument 100 according to each of the first to third embodiments described later. The CPU 201 gives an instruction to the sound source LSI 204 and voice synthesis LSI 205, which are included in a sound source unit, in accordance with the control programs. Accordingly, the sound source LSI 204 and voice synthesis LSI 205 generate and output digital music sound waveform data and digital singing voice data.

The digital music sound waveform data and digital singing voice data output from the sound source LSI 204 and voice synthesis LSI 205 are converted into an analog music sound waveform signal and an analog singing voice signal by a D/A converter 211 and a D/A converter 212, respectively. The analog music sound waveform signal and analog singing voice signal are mixed by a mixer 213 and the mixed signal is amplified by an amplifier 214. Then, the amplified signal is output from an output terminal or a speaker, not shown in particular.

To the CPU 201, a timer 210 used to control an automatic playing sequence is connected.

The ROM 202 stores control programs for performing a process according to the embodiment, various items of fixed data and automatic playing music data. The automatic playing music data includes melody data of music played by a player and accompaniment music data corresponding to the melody data. The melody data includes pitch information of each sound and sound emission timing information of each sound. The accompaniment music data may be data of a singing voice, a human voice and the like as well as accompaniment music corresponding to the melody data.

The sound emission timing of each sound may be a time between sound emissions and a time elapsed from the start of automatic playing. The unit of time is based upon a tempo called a tick used in a general sequencer. When the resolution of a sequencer is, e.g. 480, 1/480 of time of a quarter note corresponds to one tick. Note that the automatic playing music data can be stored in an information storage device and an information storage medium, neither of which is shown, as well as the ROM 202.

The format of the automatic playing music data may conform to a file format for musical instrument digital interface (MIDI).

The sound source LSI 204 reads the music sound waveform data from a waveform ROM not shown and supplies it to the D/A converter 211. The sound source LSI 204 is capable of oscillating a maximum number of 256 voices simultaneously.

Upon receiving text data of lyrics, pitch and sound length from the CPU 201, the voice synthesis LSO 205 synthesizes voice data of singing voices corresponding thereto and supplies the synthesized data to the D/A converter 212.

The key scanner 206 steadily checks a key pressing/release state of the keyboard 101 shown in FIG. 1 and a switch operating state of the first and second switch panels 102 and 103 shown in FIG. 1 and interrupts the CPU 201 to notify it of a change in the state.

The LED controller 207 is an integrated circuit (IC) designed to light a key of the keyboard 101 to navigate player's playing in response to an instruction from the CPU 201.

The LCD controller 208 is an IC designed to control the display state of the LCD 104.

A method of controlling the electronic keyboard musical instrument 100 according to the embodiment of the present invention will be described. A method of controlling an electronic keyboard musical instrument 100 according to each of first to third embodiments, which will be described below, is achieved in the electronic keyboard musical instrument 100 shown in FIGS. 1 and 2.

Figure 3:
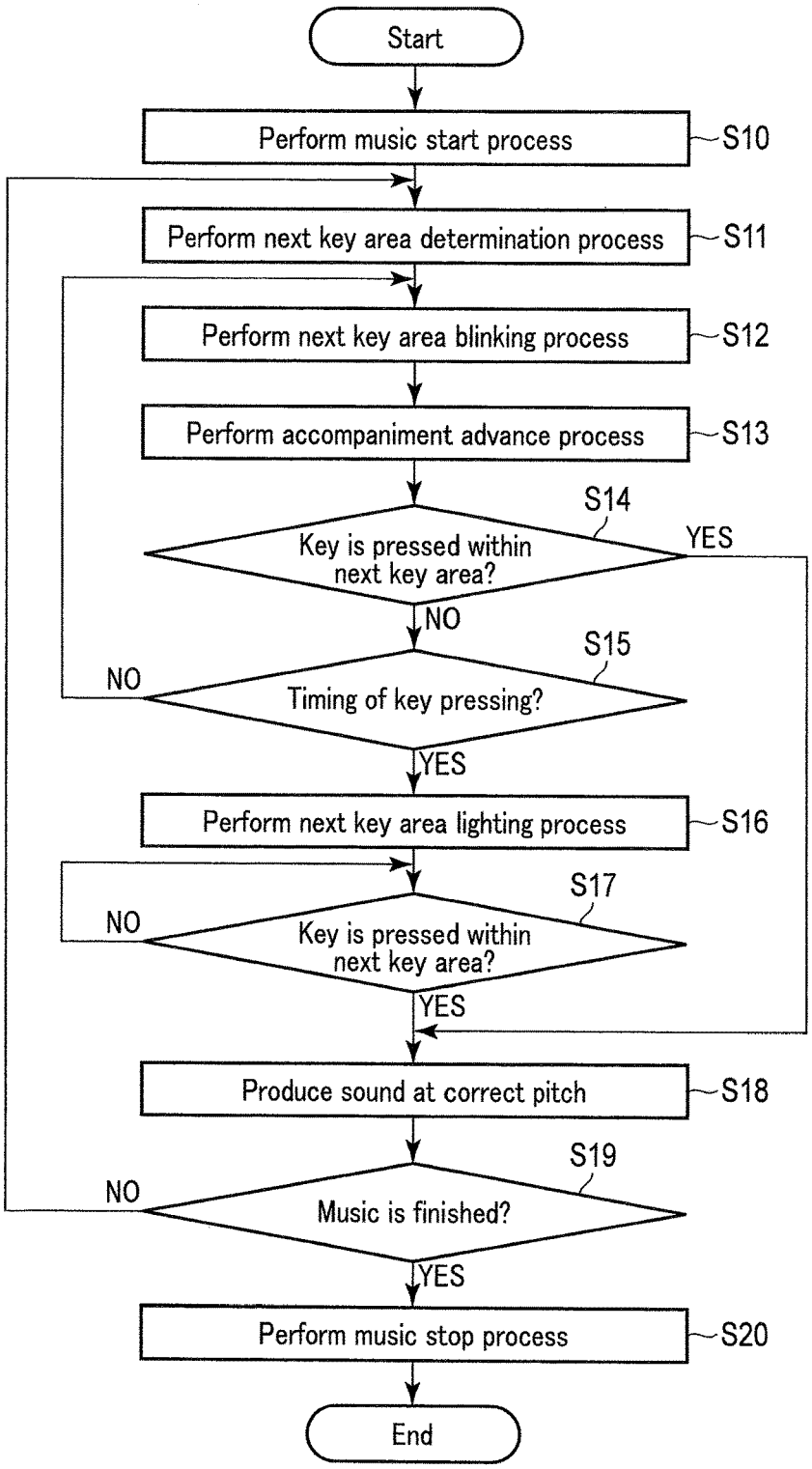
FIG. 3 is a flowchart illustrating a method of controlling an electronic keyboard musical instrument 100 according to a first embodiment of the present invention.

2. First Embodiment 2-1. Operation of Electronic Keyboard Musical Instrument 100 according to First Embodiment FIG. 3 is a flowchart illustrating a method of controlling the electronic keyboard musical instrument 100 according to the first embodiment.

When a music player selects automatic playing music with a second switch panel 103 and selects a switch (not shown) corresponding to a first lesson mode in the second switch panel 103, a music start process is performed (step S10).

In the music start process, a CPU 201 causes the player to take a first lesson on the selected automatic playing music in accordance with the control programs stored in a ROM 202. In the first lesson, the player takes lessons in playing the automatic playing music by lighting keys within a fixed range corresponding to the pitch of music sound to be designated by the player.

Then, a next key area determination process is performed (step S11). In this process, the player, who is a learner, determines keys within a pitch area of a fixed range covering a key to be pressed by the player, after introduction-reproduction and count-reproduction. In step S10, immediately after the music is started, the pitch of a key to be pressed corresponds to the first one of pitch information items included in melody data included in the automatic playing music data.

In the next key area determination process, it is determined by the pitch information items included in the melody data whether a key corresponding to the pitch of the key to be pressed is a white key or a black key.

When the CPU 201 determines that it is a white key, a plurality of keys corresponding to pitches within a fixed range are determined to be white keys from the pitch of the key to be pressed, which is allowed to be designated in accordance with the timing of the key blinking/lighting area.

When it is determined that it is a black key, a plurality of keys corresponding to pitches within a fixed range are determined to become white keys from the pitch of the key to be pressed, which is allowed to be designated in accordance with the timing of key pressing.

Next, keys within the pitch area of a fixed range of a key to be pressed by the player, which is determined in step S11, are blinked (step S12). Specifically, the CPU 201 notifies the LED controller 207 of the key number, brightness and lighting state (lighting or blinking) of the determined pitch area of a fixed range, thus blinking the keys within the pitch area of a fixed range covering a key to be pressed.

In the blinking process in step S12, a key to be pressed with correct pitch by the player is blinked brightly (first identifier) and three keys on each of the high- and low-sound sides are blinked more darkly than the key to be pressed (second identifier).

Figure 11:
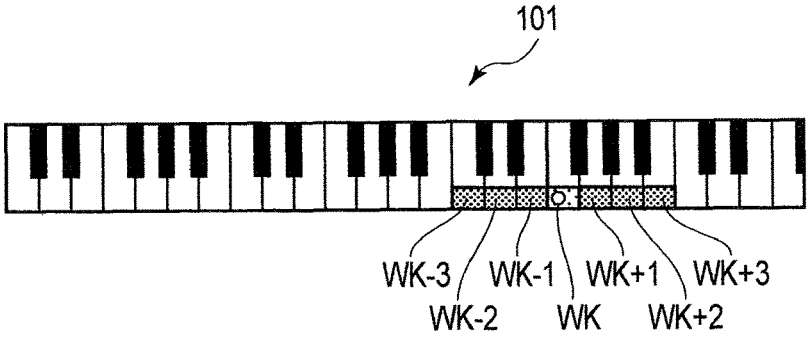
FIG. 11 is an illustration of a keyboard in which a key to be pressed with correct pitch is blinked brightly and three keys on each of high- and low-sound sides are blinked darkly.

In the first embodiment, when the key to be pressed with correct pitch is a white one, three white keys on each of the high- and low-sound sides are blinked. When the key to be pressed with correct pitch is a black one, three black keys on each of the high- and low-sound sides are blinked. FIG. 11 shows a keyboard 101 in which three white keys WK−3 on the low-sound side and three white keys WK+3 on the high-sound side, including a white key WK to be pressed, are lighted.

The white key WK shown in FIG. 11 is a first operator associated with pitch information indicating first pitch. The white keys WK−3, WK−2, WK−1, WK+1, WK+2 and WK+3 are third operators determined in relation to the first operator based upon the set conditions.

The conditions are that the third operators (e.g. white keys WK−3 to WK+3) are positioned within a predetermined range viewed from the position of the first operator (e.g. white key WK) and that the third operators (e.g. white keys WK−3 to WK+3) fall within predetermined pitch viewed from the first pitch associated with the first operator (e.g. white key WK).

Next, an accompaniment advances based upon accompaniment music data (step S13). As the accompaniment advances, music advances until immediately before the timing of key pressing.

The CPU 201 determines whether any key in the next key area that is blinked in step S12 has been pressed or not (step S14).

The CPU 201 determines that a key has been correctly pressed when any of three keys on each of the high- and low-sound sides of a darkly-blinked key of correct pitch is pressed as well as when a brightly-blinked key of correct pitch is pressed. In other words, the player can advance the music by pressing a key if the key is blinked within the next key area.

If, in step S14, the CPU 201 determines that any blinked key in the next key area has been pressed, the process shifts to step S18, in which the player produces sound with correct pitch of a key to be pressed (step S18).

If, in step S14, the CPU 201 determines that any blinked key in the next key area is not pressed, an accompaniment advances until immediately before the timing of key pressing and the CPU 201 determines whether the timing of key pressing has come (step S15). Specifically, as described above, the timing of key pressing is associated with music sound of melody data of automatic playing music data, and the CPU 201 determines the timing with which the player should press a key with correct pitch on the basis of a sequence controlled by a timer 210.

The timing of key pressing in step S15 is start timing with which the player should designate the first identifier corresponding to first pitch and included in music data on the basis of pitch information indicating the first pitch and information indicating first timing corresponding to the first pitch. In other words, the start timing is set prior to the first timing.

When the CPU 201 determines that the timing of key pressing does not come in step S15, the process returns to step S12. When the CPU 201 determines that the timing of key pressing has come in step S15, the blinked keys within a pitch area of a fixed range are changed to lighted ones (change of display mode) to notify the player that the timing of key pressing has come (step S16).

After that, the advance of music is stopped until any key in the lighted key area is pressed to wait for the player to press the key (step S17). If any key in the lighted area is pressed, the process advances as in the determination process in step S14.

When the CPU 201 determines in step S17 that any of the lighted keys is pressed, the player produces sound with correct pitch of a key to be pressed (step S18) and determines whether the music is finished based upon the automatic playing music data (step S19), When the CPU 201 determines in step S19 that the music has not been finished, the process returns to step S11, in which the pitch process of the next music sound is performed.

When the CPU 201 determines in step S19 that the music has been finished, the music stop process is performed (step S20) and the lesson in playing music according to the first embodiment of the present invention is stopped.

2-2. Modification to First Embodiment 2-2-1. Display Mode of Lighted Keys

Figure 12:
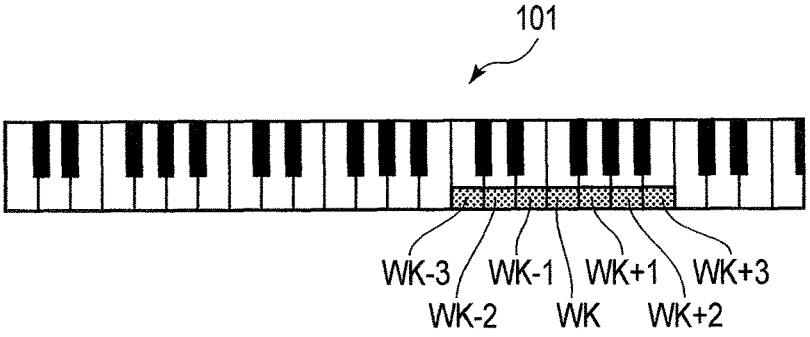
FIG. 12 is an illustration of a keyboard in which all keys (three keys)

Though the first embodiment is directed to lighted keys having a gradation lighting function, they need not have a gradation lighting function. For example, as shown in FIG. 12, the keys within a fixed range (three keys in this figure) on the higher- and lower-sound sides of a key to be pressed can be blinked or lighted.

Figure 13:
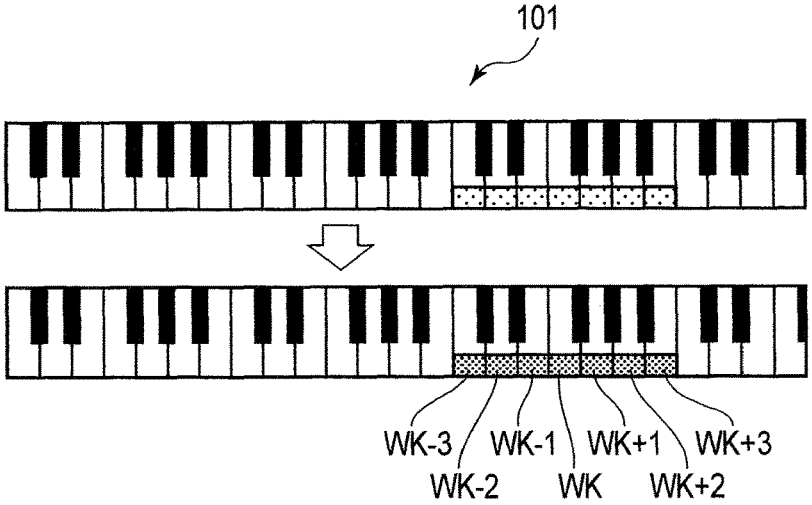
FIG. 13 is an illustration of a keyboard the brightness of which increases as the timing of key pressing comes closer.

In the first embodiment, the next key area is blinked prior to the timing of key pressing. However, as shown in FIG. 13, the keys in the area can be lighted at low brightness and the brightness of the lighted keys can be increased as the timing of key pressing comes closer (change in display mode).

2-2-2. Use of LED

The first embodiment is directed to lighted keys of the keyboard 101. However, LEDs embedded close to the keys can be blinked and lighted.

2-2-3. Type of Key to be Blinked and Lighted

In the first embodiment, when a key to be pressed is a white one, the key and its adjacent three white keys on each of the high- and low-sound sides are blinked and lighted and when a key to be pressed is a black one, the key and its adjacent three black keys on each of the high- and low-sound sides are blinked and lighted. Even though a key to be pressed with correct pitch is a white one, three white keys on each of the high- and low-sound sides and black keys included in the range of the pitch of the white keys can be blinked.

2-3. Advantages of First Embodiment

According to the electronic keyboard musical instrument 100 of the first embodiment, the key range in which music is advanced by pressing a key is fixed based on the pitch of music sound. Therefore, even a beginner who cannot chase the melody of music can learn the playing of the music roughly, while maintaining the simplicity as in the prior art in which music is advanced by pressing any key.

Furthermore, the lighted keys having a gradation function makes it possible to indicate a correct key in the key pressing range in which music is advanced.

Moreover, as described in the modification, when the brightness of the lighted keys gradually increases as the timing of key pressing comes closer, the time remaining until the timing of key pressing comes, which could not be indicated by the conventional blinking, can be represented by the brightness of the keyboard 101.

3. Second Embodiment 3-1. Operation of Electronic Keyboard Musical Instrument 100 according to Second Embodiment A method of controlling the electronic keyboard musical instrument 100 according to the second embodiment of the present invention will be described with reference to the flowchart shown in FIG. 4.

Figure 4:
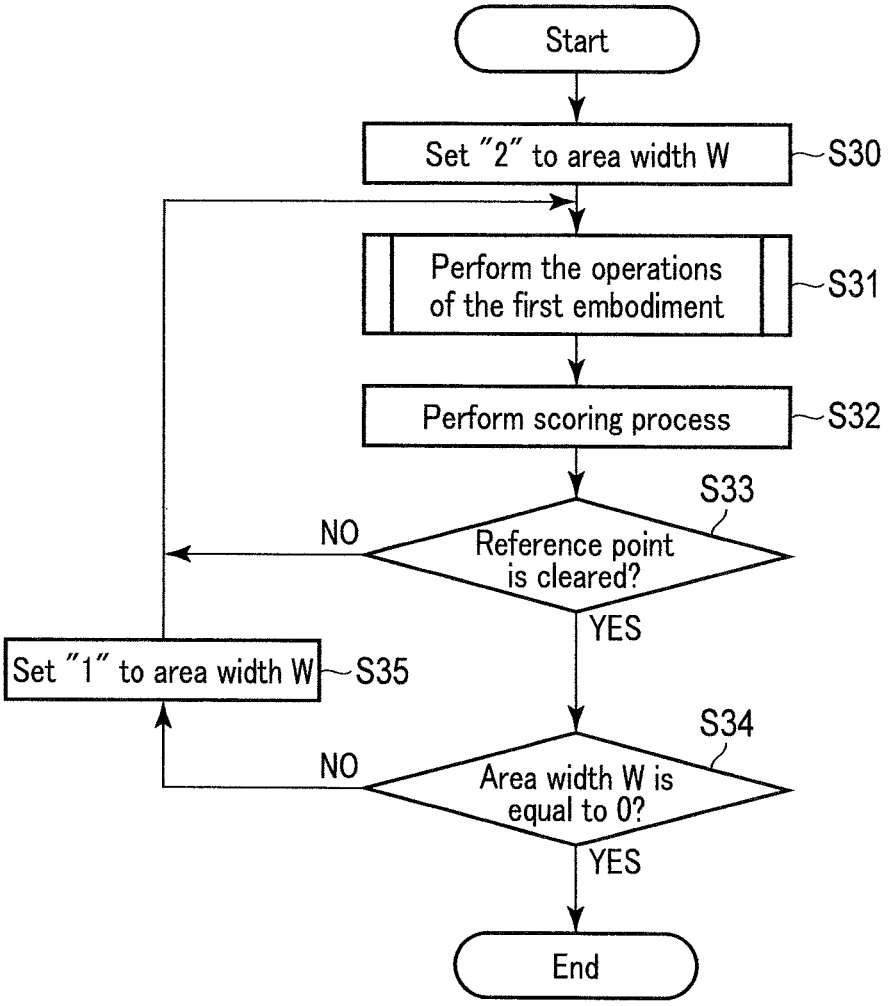
FIG. 4 is a flowchart illustrating a method of controlling an electronic keyboard musical instrument 100 according to a second embodiment of the present invention.

As shown in FIG. 4, first, "2" is set to area width W that is a variable (step S30). The area width W is a variable indicating what keys on the high- and low-sound sides of a key to be pressed should be blinked and lighted. In other words, when the area width W is equal to "2," two keys on each of the high- and low-sound sides of a key to be pressed and the key to be pressed, namely, five keys in total are blinked and lighted.

In step S31, the same operations as those of steps S1 to S20 of the first embodiment are performed. However, in place of the music start process in step S10 shown in FIG. 1, in the second embodiment, when automatic playing music is selected by the second switch panel 103 and a switch (not shown) in the second switch panel 103, which corresponds to a second lesson mode according to the second embodiment, is selected, a music start process is performed.

In the second embodiment, furthermore, the operations of the first embodiment are performed with the key blinking/lighting area as an area of five keys including the key to be pressed. The player as a learner presses any key within the key blinking/lighting area in accordance with the timing of key pressing to advance the music.

When the playing of one musical piece is finished, scoring process is performed (step S32). In the scoring process, differences between the timing of key pressing in step S31 and the timing with which the learner actually pressed a key are accumulated and the accumulated differences are used as a scoring index. In other words, the less the accumulated time differences, the more correct the player's key pressing timing, thus making a high score. As another scoring process, a higher score is made as the player presses a key closer to the key to be pressed within the key blinking/lighting area.

Next, the CPU 201 determines that the score made by the scoring process in step S32 satisfies a reference point (step S33). When the score does not satisfy the reference point, the process in step S31 of the first embodiment is performed again in the same key blinking/lighting area.

When the CPU 201 determines in step S33 that the score satisfies the reference point, it determines whether the area width W is "0" or not (step S34). When the CPU 201 determines in step S34 that the width area W is not "0," "1" is subtracted from the width area W (step S35), and the process returns to step S31. In the next loop, the area width W becomes equal to "1." In other words, the number of keys in the key blinking/lighting area is three including a key to be pressed and the area of keys to be pressed is narrowed. In this state, the process of the first embodiment is performed again (step S31). For the player as a learner, therefore, the degree of difficulty in clearing the reference point becomes higher than that in the first loop.

When the process in step S31 is terminated again and the reference point is cleared after the scoring process in step S32, the area width W becomes "0." In other words, in the next loop, no keys other than a correct key in the keyboard 101 are blinked or lighted. The learner is thus required to press a correct key with correct timing.

If the reference point is cleared when the area width W is "0," the CPU 201 determines that the learner has mastered the music and the process is terminated (YES in step S34).

3-2. Modification to Second Embodiment

Figure 5:
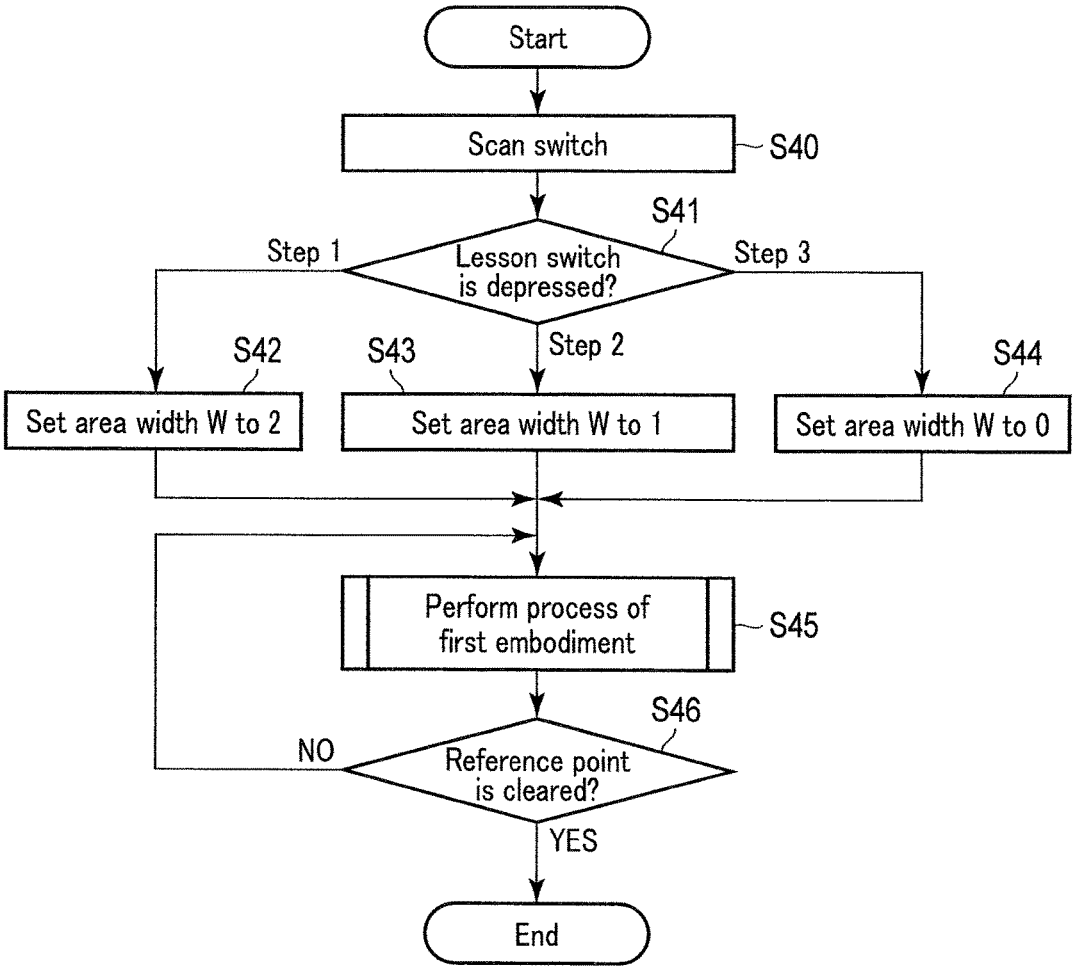
FIG. 5 is a flowchart showing an operation of a modification to the electronic keyboard musical instrument according to the second embodiment.

FIG. 5 is a flowchart showing an operation of a modification to the second embodiment. In the second embodiment, the key blinking/lighting area width W decreases from "2" to "0" each time the scoring results clears the reference point. However, the learner may select the area width W. The shorter the area width W, the higher the degree of difficulty in taking lessons.

Specifically, the second switch panel 103 is scanned (step S40) to determine which of a first area width switch (step 1: W=2), a second area width switch (step 2: W=1) and a third area width switch (step 3: W=0) (none of which is shown) of the second switch panel 103 is depressed (step S41) and set a key blinking/lighting area width W. In other words, the learner selects the degree of difficulty in lesson.

In step S41, the area width W is set to "2" when the CPU 201 determines that the first area width switch of the second switch panel 103 is depressed (step S42), it is set to "1"

when the CPU 201 determines that the second area width switch thereof is depressed (step S43), and it is set to "0" when the CPU 201 determines that the third area width switch thereof is depressed (step S44).

The subsequent process is similar to that of the second embodiment. However, the key blinking/lighting area width W corresponding to the degree of difficulty is not updated, but the process of the first embodiment (step S45) is repeated until the reference point is cleared and terminated if the reference point is cleared at the degree of difficulty (step S46).

3-3. Advantages of Second Embodiment

In the second embodiment, the key blinking/lighting range is decreased gradually from its wide state. The learner can thus start playing music roughly and finally learn playing music correctly.

4. Third Embodiment 4-1. Operation of Electronic Keyboard Musical Instrument 100 according to Third Embodiment In the third embodiment, a player plays music with both hands.

A method of controlling the electronic keyboard musical instrument 100 according to the third embodiment of the present invention will be described with reference to the flowchart shown in FIGS. 6 and 7.

When a music player selects automatic playing music with a second switch panel 103 and selects a switch (not shown) corresponding to a third lesson mode in the second switch panel 103 to play music with both hands, a music start process is performed (step S50).

In the music start process, a CPU 201 causes the player to take a third lesson on the selected automatic playing music in accordance with the control programs stored in a ROM 202. In the third lesson, the player takes lessons in playing the automatic playing music by lighting keys within a fixed range corresponding to the pitch of music sound to be designated by the player.

In step S51, left-hand next key pressing timing and right-hand next key pressing timing are set to variable LT (Left Timing) and variable RT (Right Timing), respectively. The next key pressing timing corresponds to the duration from the current music to the pressing of the next key. As described above, the unit of time is based upon a tempo called a tick used in a general sequencer. The method of using the variables LT and RT will be described later.

Then, a next key area determination process is performed (step S52). In this process, the player, who is a learner, determines keys within a pitch area of a fixed range covering a key to be pressed by the player. Since the third embodiment is directed to a third lesson mode targeted for music played with both hands, the player determines keys of a left-hand area of a fixed range covering a key to be pressed with the left hand and keys of a right-hand area of a fixed range covering a key to be pressed with the right hand.

In step S53, a next key area blinking process is performed. Like in the first embodiment, this process is a process of blinking an area including a key to be pressed next; however, the player's operation is different because the player plays music with both hands. The operation will be described in detail later.

Next, an accompaniment is advanced based upon accompaniment music data (step S54). As the accompaniment advances, music advances until immediately before the timing of key pressing.

After that, the CPU 201 confirms whether any key in the next key area blinked in step S53 prior to the timing of key pressing (step S55). This process will also be described in detail later.

When the CPU 201 confirms that a key has been pressed (YES in step S56) in the next key area key pressing confirmation process in step S55, the process moves to step S61, in which the player produces sound with correct pitch of a key to be pressed (step S61). When no key is pressed (NO in step S56), an accompaniment advances until immediately before the timing of key pressing and the CPU 201 determines whether the timing of key pressing has come (step S57).

When the CPU 201 determines that the timing of key pressing does not come in step S57, the process returns to step S53. When the CPU 201 determines that the timing of key pressing has come in step S57, the blinked keys within a pitch area of a fixed range are changed to lighted ones to notify the player that the timing of key pressing has come (step S58). This process will also be described in detail later.

After that, the CPU 201 determines whether any key in the lighted next key area has been pressed (step S59). This process will also be described in detail later.

When the CPU 201 does not confirm that a key has been pressed (NO in step S60) in the next key area key pressing confirmation process in step S59, the advance of music is stopped until any key in the lighted key area is pressed to wait for the player to press the key. When the CPU 201 confirms that a key has been pressed (YES in step S60), the player produces sound with correct pitch of a key to be pressed (step S61), and the process moves to the process of step S62, in which the CPU 201 determines whether music has been finished or not.

When the CPU 201 determines in step S62 that the music has not been finished, the process returns to step S51, in which the pitch process of the next music sound is performed. When the CPU 201 determines in step S62 that the music has been finished, the music stop process is performed (step S63) and the lesson in playing music according to the third embodiment of the present invention is stopped.

The next key area blinking process of step S53 will be described in detail below.

Figure 8:
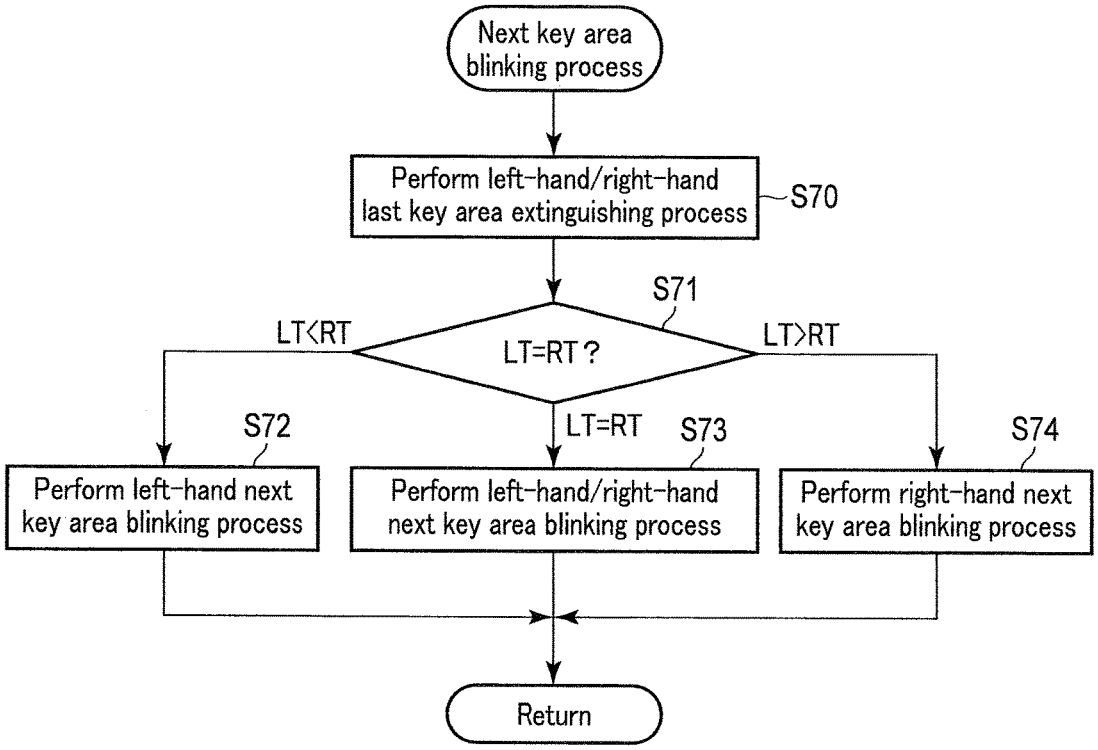
FIG. 8 is a flowchart illustrating an operation of a next key area blinking process at S53.

FIG. 8 is a flowchart illustrating an operation of the next key area blinking process of step S53.

First, the currently lighted key area is extinguished (step S70). This process is redundant because none of the keys is lighted immediately after music is started, but it is performed for simplification because it does not matter that an extinguishing process is performed for the keys that are not lighted.

Then, the variables LT and RT set in step S51 are compared with each other. In other words, time required from the position of the current music to the left-hand next key pressing and time from the position of the current music to the right-hand next key pressing are compared with each other (step S71).

When the variable LT is smaller than the variable RT, or when the left-hand key pressing timing is earlier than the right-hand key pressing timing, an area of the left hand only is blinked (step S72).

When the variables LT and RT are equal, or when time required from the position of the current music to the left-hand next key pressing and time required from the position of the current music to the right-hand next key pressing are equal, areas of both the right and left hands are blinked (step S73).

When the variable LT is larger than the variable RT, or when the right-hand key pressing timing is earlier than the left-hand key pressing timing, an area of the right hand only is blinked (step S74).

The next key area lighting process in step S58 is substituted for the next key area blinking process.

Figure 10:
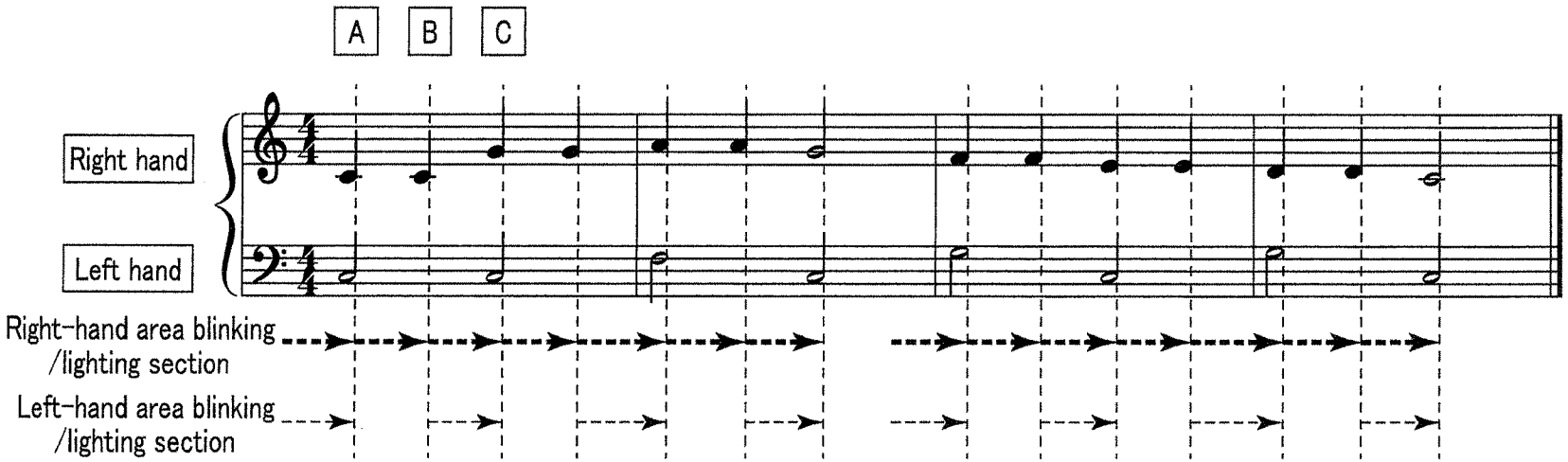
FIG. 10 is a diagram illustrating an example of both-hand playing music.

The next key area lighting process will be described specifically. In the both-hand playing music shown in FIG. 10, time required from the start position of the music to point A for the right hand and that for the left hand are equal. In other words, variable LT is equal to variable RT. In this case, both the right- and left-hand areas are blinked until point A and lighted when they reach point A.

The next key pressing timing of the right hand is point B and that of the left hand is point C, viewed from point A. In other words, variable LT is larger than variable RT. In this case, only the right-hand area is blinked and the left-hand area is extinguished in step S70 in FIG. 8 and thus not blinked. When the hands reach point B, the right-hand area is lighted and the left-hand area is still extinguished.

Figure 14:
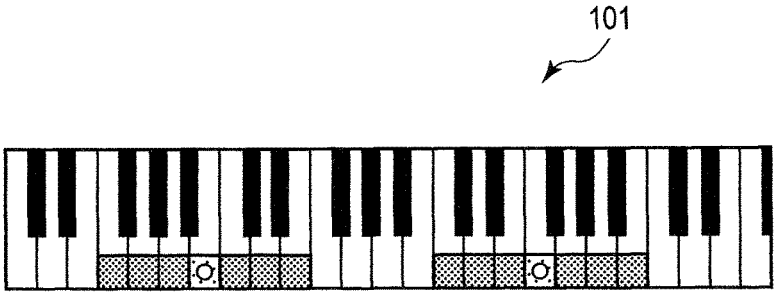
FIG. 14 is an illustration of a keyboard 101 in which both the right- and left-hand areas are lighted.

In other words, a learner can be notified that he or she needs to press the keys with both hands at point A where both the right- and left-hand areas are lighted and has only to press a key with only the right hand at point B where only the right-hand area is lighted. The same holds true for the process at point C and its subsequent processes. FIG. 14 is an illustration of a keyboard in which both the right- and left-hand areas are lighted.

The next key area key pressing confirmation process (steps S55 and S59) in FIG. 6 will be described below.

Figure 9:
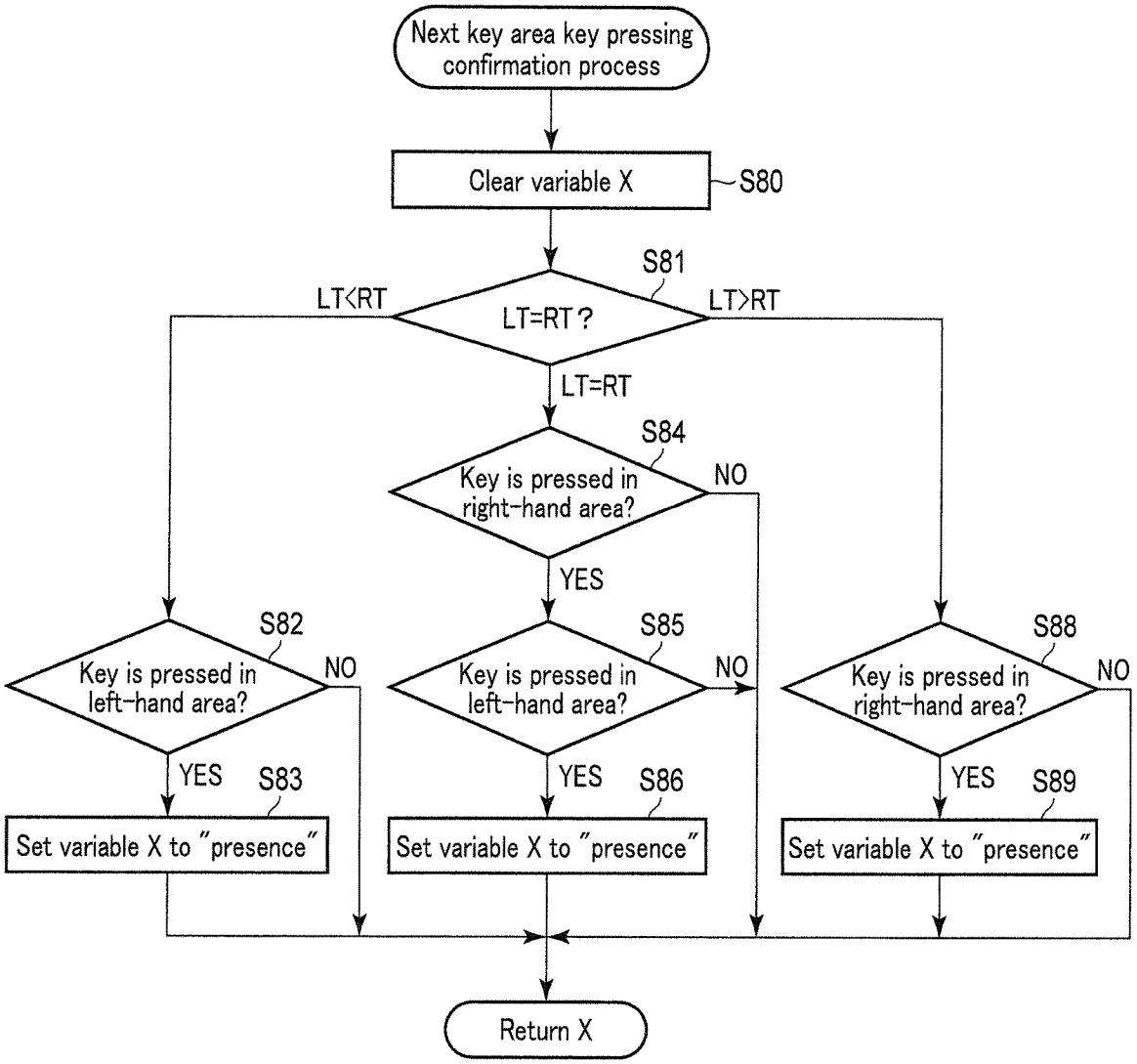
FIG. 9 is a flowchart illustrating an operation of a next key area key pressing confirmation process (S55, S59).

FIG. 9 is a flowchart illustrating an operation of the next key area key pressing confirmation process (steps S55 and S59). First, variable X to hold the presence or absence of key pressing (step S80).

Then, variables LT and RT are compared with each other (step S81).

When variable LT is smaller than variable RT, it is only the left-hand area that is blinked and lighted and thus it is confirmed whether a key has been pressed in the left-hand area (step S82). When a key has been pressed, variable X is set to "presence" (step S83). When no key is pressed in the left-hand area, variable X is set to "absence" (NO in step S82).

When variables LT and RT are equal, both the right- and left-hand areas are blinked and lighted. In this case, it is determined that a key is pressed only when keys have been pressed in both the right- and left-hand areas (steps S84, S85 and S86). In other words, when both the right- and left-hand areas are blinked and lighted, music does not advance unless keys in both the areas are pressed. When no key is pressed in one of the right- and left-hand areas, variable X is set to "absence" (NO in step S84, NO in step S85).

When variable LT is larger than variable RT, it is only the right-hand area that is blinked and lighted and thus it is confirmed whether a key has been pressed in the right-hand area (step S88). When a key has been pressed, variable X is set to "presence" (step S89). When no key is pressed in the right-hand area, variable X is set to "absence" (NO in step S88).

Figure 6:
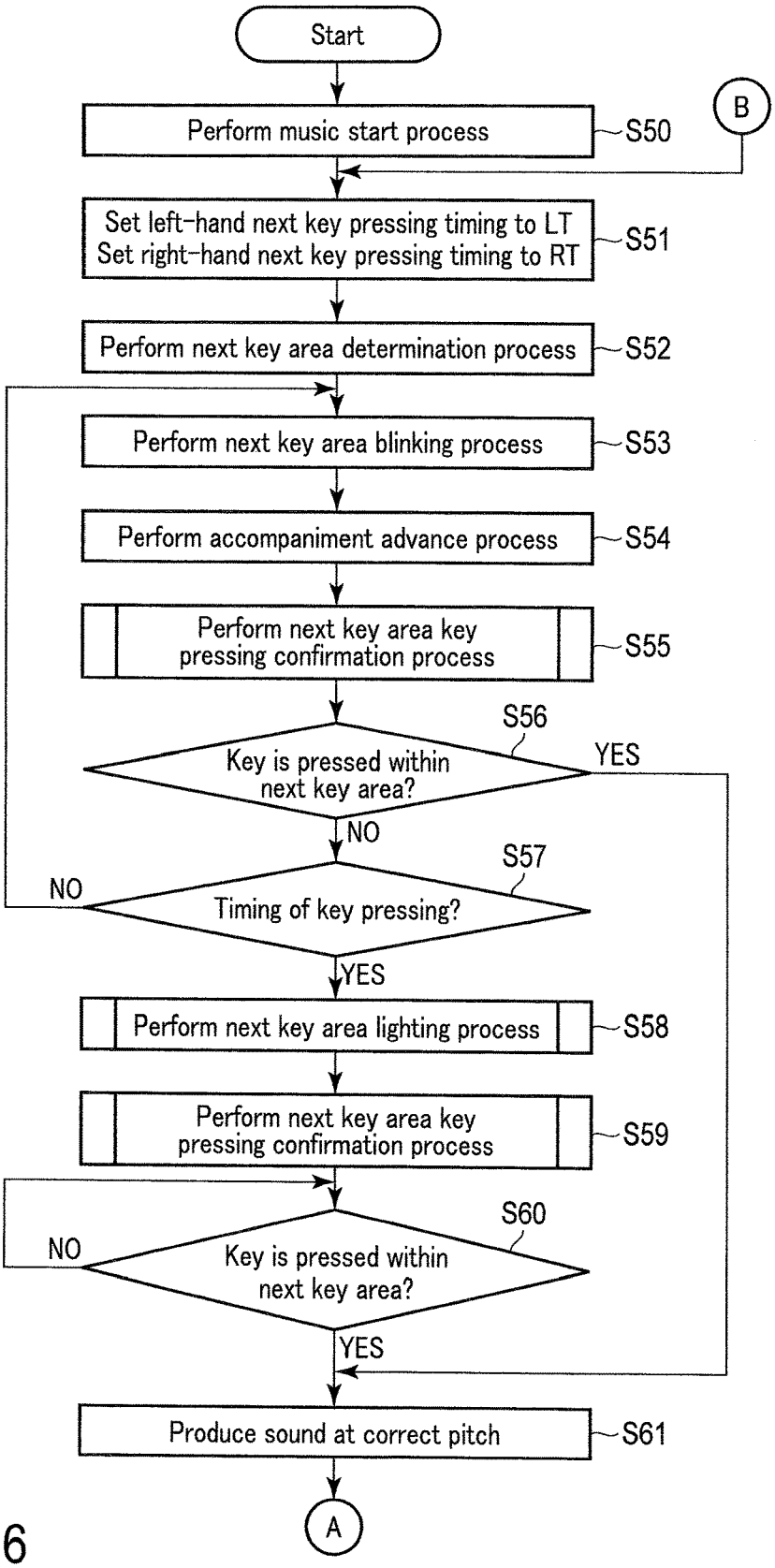
FIG. 6 is a flowchart illustrating a method of controlling an electronic keyboard musical instrument 100 according to a third embodiment of the present invention.
Figure 7:
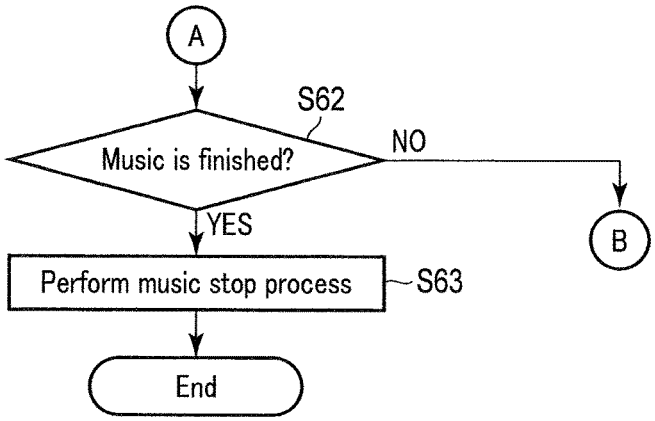
FIG. 7 is a flowchart illustrating the method of controlling the electronic keyboard musical instrument 100 according to the third embodiment.

In this key area key pressing confirmation process, variable X can be returned as a return value to determine the presence or absence of key pressing using variable X in steps S56 and S60 in FIG. 6.

As described above, according to the third embodiment, the present invention can be applied to both-hand playing music, too. According to the third embodiment, furthermore, the present invention can be applied to a lesson as described in the second embodiment.

Figure 15:
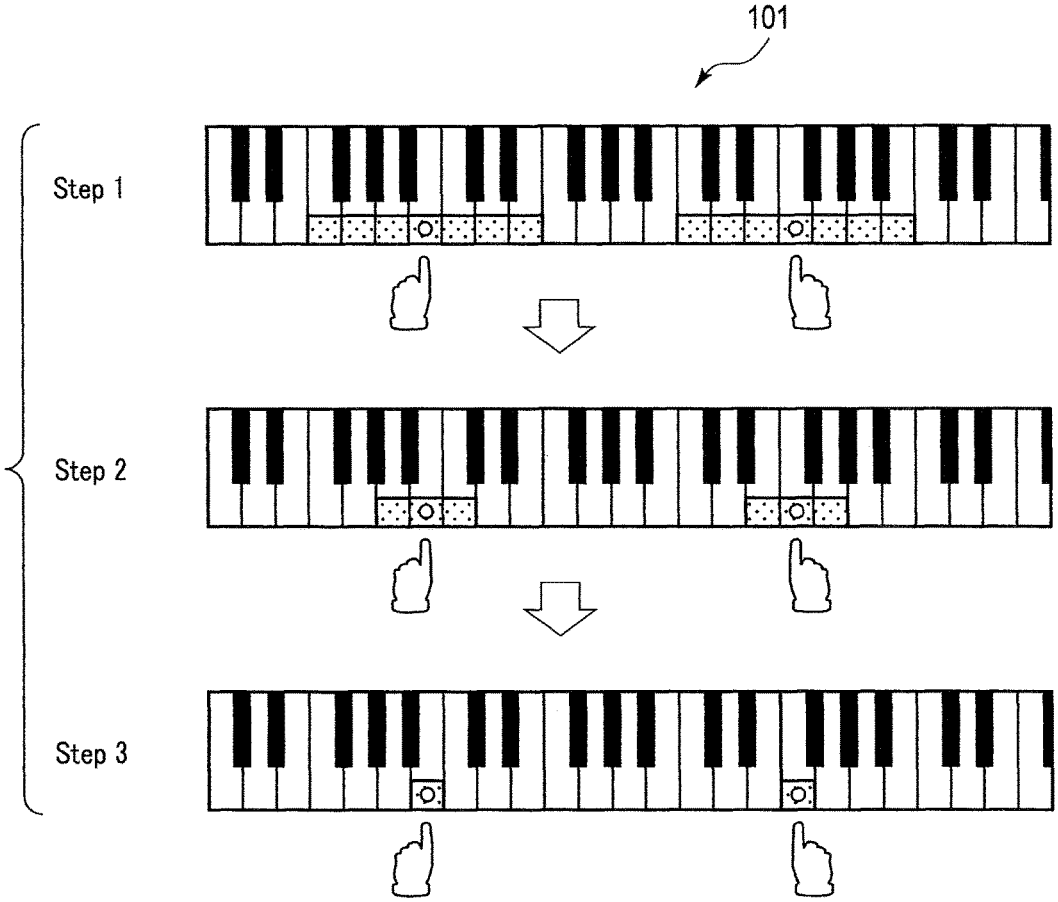
FIG. 15 is an illustration of a keyboard 101 in which the right- and left-hand blinking/lighting areas are gradually narrowed.

In this case, as shown in FIG. 15, the right- and left-hand blinking/lighting areas are gradually narrowed (step 1 step 2 step 3). Finally, only keys to be pressed with correct pitch are lighted.

In the case of FIG. 15, the CPU 201 performs a determination process to determine whether a result of the player's playing reaches a certain reference. The certain reference has been described in, e.g. FIG. 4. It has been described whether the score made by the scoring process in step S32 clears a reference point (step S33). However, the present invention is not limited to this process. The CPU 201 may determine whether the number of times the player plays music has reaches a preset number of times.

The above-described conditions are set in such a manner that the number of third operators, which is determined in relation to the first operator after the CPU 201 has determined that a result of the player's playing reaches a certain reference (e.g. step 2 in FIG. 15), becomes smaller than the number of third operators, which is determined in relation to the first operator before the CPU 201 determines that a result of the player's playing reaches the certain reference (e.g. step 1 in FIG. 15).

The conditions are also set in such a manner that as the CPU 201 determines that a result of the player's playing reaches the certain reference, the number of third operators decreases gradually (step 1→step 2→step 3 in FIG. 15).

4-2. Advantages of Third Embodiment

According to the electronic keyboard musical instrument 100, the lessons of the first and second embodiments can be applied to both-hand playing music.

According to the electronic keyboard musical instrument 100 of each of the embodiments, the player can learn a certain range covering a key of correct pitch as well as the timing of key pressing. It is particularly possible for a beginner to feel as if he or she were playing the music.

In the foregoing embodiments, a plurality of keys that can be designated by a player are lighted simultaneously. When the player designates any of the lighted keys, a sound producing unit produces sound corresponding to a first pitch included in music data. However, the sound producing unit may produce sound corresponding to the key designated by the player. In other words, when the player does not press the key designating the first pitch included in the music data, the sound producing unit does not produce sound corresponding to the first pitch but may produce sound corresponding to the key designated by the player to advance the music data. In this case, the player can notice that he or she pressed a wrong key.

Specific embodiments of the present invention were described above, but the present invention is not limited to the above embodiments, and modifications, improvements, and the like within the scope of the aims of the present invention are included in the present invention. It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

The invention claimed is:

1. An electronic musical instrument comprising:

a plurality of keys that are operable to designate pitches of sound to be output by the electronic musical instrument; and a processor that is configured to perform an automatic playing process including:

determining one of the plurality of keys to be a first key, based on pitch information indicating a first pitch of a first timing included in music data, wherein the first key is expected to be designated by a user within a first period according to the first timing;

determining one of the plurality of keys to be a second key based on pitch information indicating a second pitch of a second timing after the first timing included in the music data, wherein the second key is expected to be designated by the user within a second period according to the second timing;

determining at least one of the plurality of keys other than the first key to be at least one third key that is assigned a sound of a different pitch from the first pitch, wherein the at least one third key is determined based on a position or pitch relationship of said at least one of the plurality of keys with the first key;

displaying an identifier for identifying the at least one third key before the first timing in accordance with progressing of the music data; and in response to an operation by the user designating the first key or the at least one third key, controlling the electronic musical instrument to output a sound of the first pitch, and progressing the music data from the first timing to a timing before the second timing;

wherein the processor does not progress the music data from the first timing to the timing before the second timing, when the user designates a key other than the first key or the at least one third key within the first period.

2. The electronic musical instrument of claim 1, wherein the at least one third key is positioned within a predetermined positional range with respect to a position of the first key.

3. The electronic musical instrument of claim 1, wherein the at least one third key falls within predetermined pitch range with respect to viewed from the first pitch associated with the first key.

4. The electronic musical instrument of claim 1, wherein:

the processor is configured to perform a determination process of determining whether a result of playing of the user reaches a certain reference; and a quantity of the at least one third key, which is determined in relation to the first key after it is determined in the determination process that the result of playing of the user reaches the certain reference, is smaller than the quantity of the at least one third key, which is determined in relation to the first key before it is determined in the determination process that the result of playing of the user reaches the certain reference.

5. The electronic musical instrument of claim 1, wherein:

the processor is configured to perform a determination process of determining whether a result of playing of the user reaches a certain reference; and as it is determined that the result of playing of the user reaches the certain reference, a quantity of the at least one third key decreases gradually.

6. The electronic musical instrument of claim 1, wherein:

the processor is configured to perform a scoring process of scoring playing of the user and a determination process of determining whether a result of playing of the user reaches a certain reference; and a quantity of the at least one third key, which is determined in relation to the first key after it is determined in the determination process that the result of playing of the user reaches the certain reference, is smaller than the quantity of the at least one third key, which is determined in relation to the first key before it is determined in the determination process that the result of playing of the user reaches the certain reference.

7. The electronic musical instrument of claim 1, wherein:

the processor is configured to perform a white-key/black-key determination process of determining which of a white key and a black key the first key to be designated by the user is;

the at least one third key is set to include white keys only when it is determined in the white-key/black-key determination process that the first key is the white key; and the at least one third key is set to include black keys only when it is determined in the white-key/black-key determination process that the first key is the black key.

8. The electronic musical instrument of claim 1, wherein the processor is configured to perform a display mode changing process of changing a display mode of the identifier to be displayed before and after a lapse of the first timing.

9. The electronic musical instrument of claim 1, wherein the processor is configured to perform a display mode changing process of changing a display mode of the identifier to be displayed from timing that is earlier than the first timing toward the first timing.

10. A method of causing a computer of an electronic musical instrument, which includes plurality of keys that are operable to designate pitches of sound to be output by the electronic musical instrument, to perform a process comprising:

determining one of the plurality of keys to be a first key, based on pitch information indicating a first pitch of a first timing included in music data, wherein the first key is expected to be designated by a user within a first period according to the first timing;

determining one of the plurality of keys to be a second key, based on pitch information indicating a second pitch of a second timing after the first timing included in the music data, wherein the second key is expected to be designated by the user within a second period according to the second timing;

determining at least one of the plurality of keys other than the first key to be at least one third key that is assigned a sound of a different pitch from the first pitch, wherein the at least one third key is determined based on a position or pitch relationship of said at least one of the plurality of keys with the first key;

displaying an identifier for identifying the at least one third key before the first timing in accordance with progressing of the music data; and in response to an operation by the user designating the first key or the at least one third key, controlling the electronic musical instrument to output a sound of the first pitch, and progressing the music data from the first timing to a timing before the second timing;

wherein the processor does not progress the music data from the first timing to the timing before the second timing, when the user designates a key other than the first key or the at least one third key within the first period.

11. A non-transitory computer-readable storage medium which stores a program that is executable by a computer of an electronic musical instrument, which includes a plurality of keys that are operable to designate pitches of sound to be output by the electronic musical instrument, the program being executable by the computer to control the electronic musical instrument to perform a process comprising:

determining one of the plurality of keys to be a first key, based on pitch information indicating a first pitch of a first timing included in music data, wherein the first key is expected to be designated by a user within a first period according to the first timing;

determining one of the plurality of keys to be a second key, based on pitch information indicating a second pitch of a second timing after the first timing included in the music data, wherein the second key is expected to be designated by the user within a second period according to the second timing;

determining at least one of the plurality of keys other than the first key to be at least one third key that is assigned a sound of a different pitch from the first pitch, wherein the at least one third key is determined based on a position or pitch relationship of said at least one of the plurality of keys with the first key, the program comprising:

displaying an identifier for identifying the at least one third key before the first timing in accordance with progressing of the music data; and;

in response to an operation by the user designating the first key or the at least one third key, controlling the electronic musical instrument to output a sound of the first pitch, and progressing the music data from the first timing to a timing before the second timing;

wherein the processor does not progress the music data from the first timing to the timing before the second timing, when the user designates a key other than the first key or the at least one third key within the first period.

* * * * *